US005509878A

United States Patent [19]

Denega et al.

[11] Patent Number: 5,509,878

[45] Date of Patent: Apr. 23, 1996

[54] RESIST/ASSIST EXERCISER AND ITS USE

[76] Inventors: Craig Denega, 13063 Townsend Rd., Philadelphia, Pa. 19154; John F. Dalton, 329 Devonshire Rd., Devon, Pa. 19333

[21] Appl. No.: 215,038

[22] Filed: Mar. 18, 1994

Related U.S. Application Data

[62] Division of Ser. No. 640,988, Jan. 14, 1991, Pat. No. 5,304,108.

[51] Int. Cl.[6] ..... A63B 21/22; A63B 21/08

[52] U.S. Cl. ..... 482/110; 482/93; 482/97

[58] Field of Search ..... 482/93, 97, 105, 482/110, 106, 109, 148

[56] References Cited

U.S. PATENT DOCUMENTS

| | | | |
|---|---|---|---|
| 2,603,486 | 7/1952 | Hughes | 272/79 |
| 4,077,626 | 3/1978 | Newman | 272/58 |
| 4,249,725 | 2/1981 | Mattox | 272/117 |
| 4,396,188 | 8/1983 | Dreissigacker et al. | 272/72 |
| 4,470,597 | 9/1984 | McFee | 272/128 |
| 4,640,508 | 2/1987 | Escher | 272/128 |
| 4,647,036 | 3/1987 | Huszczuk | 272/73 |
| 4,674,741 | 6/1987 | Pasierb, Jr. et al. | 272/72 |
| 4,709,919 | 12/1987 | Cano | 272/117 |
| 4,714,244 | 12/1987 | Kolomayets et al. | 272/72 |
| 4,728,099 | 3/1988 | Pitre | 482/110 |
| 4,799,475 | 1/1989 | Iams et al. | 128/25 |
| 4,900,014 | 2/1990 | DeGraff | 272/73 |
| 4,900,017 | 2/1990 | Bold | 482/110 |
| 4,923,193 | 5/1990 | Pitzen et al. | 272/73 |

*Primary Examiner*—Stephen R. Crow
*Attorney, Agent, or Firm*—Elman & Fried

[57] ABSTRACT

An exercise apparatus adapted to provide resistance to an exercising user who attempts to induce an exercise stroke of the apparatus and which is also adapted so that once the exercising user has initiated the exercise stroke along the stroke path the user may: (1) continue to exert a force along the stroke path; (2) exert a force opposite the exercise stroke path, this force will also be resisted by the apparatus; (3) exert no force, in which case the apparatus will continue the exercise stroke path; or (4) the user may initiate some combination of the above actions. The exercise apparatus being further adapted so that gravity and friction do not have a significant effect on the resistance or assistance that the user confronts. Embodiments of the invention encompass exercise stroke paths in up to three dimensions, whereby the user may perform linear, rotational, or a combination of both movements in exercising with the apparatus. Mechanical embodiments of the invention utilize inertia to present forces that provide the user with the resist/assist feature. Hydraulic embodiments utilize the creation of a current of an essentially incompressible fluid to provide the resist/assist feature to a user.

12 Claims, 11 Drawing Sheets

RESIST/ASSIST EXERCISER AND ITS USE

This is a division of application Ser. No. 07/640,988 filed on Jan. 14, 1991 now Pat. No. 5,304,108.

FIELD OF THE INVENTION

This invention relates to an exercise apparatus and method for its use.

BACKGROUND OF THE INVENTION

The typical exercise apparatus provides a resisting force in only one direction per exercise stroke for the exercising user to work against. The resisting force operates to dissipate the user's energy during an exercise stroke. Examples of this are free-weights, weight machines and bicycle-type exercise apparatus. Free-weights and weight machines limit the user's motion to one plane. They also provide a resisting force, while the weight is applied in a direction opposite the intended motion, that dissipates the user's energy by lifting the opposing weight. Bicycle-type exercise apparatus may provide a resisting force that dissipates the exercising user's energy in a number of different ways: many employ a means to adjust the frictional resistance of an element of the apparatus that the user must exert against; some employ air resistance through fan blades that rotate as the user exerts force. These devices typically provide resistance to the user in one direction per exercise stroke. The disadvantage of such apparatus is that the user exercises only one group of muscles during each exercise stroke, since the resistance is in only one direction. A further disadvantage is there are no provisions to continue motion of the exercise stroke without the exercising user exerting a force on the apparatus. A further disadvantage of such apparatus is that the exercise only occurs when starting, holding, or maintaining the motion in the direction initiated against the resistance. Another disadvantage is that the user must adjust the amount of resisting force in order to dissipate the desired amount of energy within a given number of exercise strokes (i.e. change the amount of weight on free weights, increase the amount of friction on the bicycle-type apparatus, etc.). Still another disadvantage is that the user may not safely release from conventional gravity resistance apparatus (free weights or weight machines) in mid stroke if the user becomes disabled for some reason.

SUMMARY OF THE INVENTION

It would be of value to provide exercise apparatus (sometimes referred to for short as an "exerciser") that allows a user to exercise more than a single group of muscles during an exercise stroke. Muscle groups are configured in the human body pairs. It would be advantageous for both members of such pair to be equally exercised during each exercise stroke. The exercise stroke is a movement of extremities of the user, i.e. the hands or feet, from a starting position to an ending position. For example, a user doing a bench press would start an initial stroke with his hands at chest level and end with his arms extended upwards. Generally such an exercise stroke is followed by a second, or return stroke, starting from the position at which the first stroke ended and returning to the starting position. Thus the return stroke of a bench press would start with the arms extended and end with the hands again at chest level.

It would be of further advantage to enable a user to initiate an exercise stroke performing work against the resistance of the exerciser and then discontinue pushing against the exerciser while it assists the user through a difficult or unfamiliar segment the exercise stroke. The user could then return to transferring energy into the exerciser for the remaining portion of the stroke. This would allow the exerciser to be used in a therapeutic role. If a user has difficulty moving muscles or joints through a particular segment of their range of motion or in exerting significant muscular force, the exerciser would assist the user during that part of the stroke.

It would also be of value to have an exerciser that would allow different users to utilize the exerciser without the need to readjust the exerciser for each user's ability transfer energy into the apparatus. But, the exerciser would still provide some adjustment that does not require significant alteration of the apparatus when users significantly different abilities use it.

The present invention involves a resist-assist exercise device that provides the user with an exercise stroke that resists a user's force and subsequently during the same exercise stroke presents a force that assists movement in the same direction as the user applied force. As this assisting force is presented, it would have any of the following results: (1) assist an exercising user in moving muscles through a segment of the exercise stroke; (2) provide a force, in a direction generally opposite to the first resisting force, for the user to exert resistance against during the exercise stroke; or (3) provide sufficient energy at the end of the exercise stroke to extend and possibly gently stretch the user's muscles along the path of the initial stroke.

In its primary aspect, the invention (exerciser) provides a means for the user to initiate an exercise stroke. At the same time, the exerciser provides a resistance opposite to the force of the user in response to the user induced stoke. The resistance provided by the exerciser is independent of gravity and frictional forces and as closely as possible equals the force exerted by the user. The energy exerted by the user is stored within the exerciser and may be used by the user to assist the user to complete the stroke. Alternatively, the user may work against the energy stored within the exerciser to terminate the stroke. In this manner, the user has exercised opposing sets of muscles during one stroke. The exerciser is configured so that an equal amount of energy may pass from the user to the exerciser and from the exerciser to the user.

The exercise apparatus provides to the user an exercise stroke that has first a resist segment and then an assist segment. The user interfaces with the exerciser through a thrust receiver, which is adapted to provide a positive connection to an extremity of the user. The thrust receiver is capable of being displaced along the path of the exercise stroke. The exerciser contains a means for providing a resisting force in response to the displacement of the thrust receiver, which is displaced as a result of the work or energy exerted by the user against the thrust receiver. A positive connection exists between the thrust receiver and resisting means that allows the user's force to be transmitted to the resisting means. Additionally, the exerciser contains a means for providing an assist to the user during the exercise stroke. This assist is substantially equal to the amount of work previously exerted by the user during the resist segment of the exercise stroke. A positive connection exists between the thrust receiver and assisting means that allows the assisting force to be transmitted to the thrust receiver.

The exerciser comprises a thrust receiver, which is the interface between the user and the exerciser. The thrust receiver is adapted to provide a positive connection between the user and the exerciser. The exerciser is used by attaching a pair of the user's extremities, either hands or feet or optionally hands and feet, to a thrust receiver that is shaped or otherwise adapted to receive and transmit force between the user's extremities and the apparatus. For example, the thrust receiver could be a pair of handgrips for the hands to grasp. In a preferred embodiment, the hand grips would have provisions to be adjustable so that different wrist angles may be obtained depending on the motion of the stroke or for the comfort of the user. Additionally, the thrust receiver could be toe clips such as used on racing bicycles, shoes, cuffs, or straps which the lower extremity (inclusive of the foot and ankle) may be properly secured as required by the stroke motion. In a preferred embodiment, the thrust receiver for the lower extremity would have provisions to be adjustable so that different foot or ankle angles may be obtained depending on the motion of the stroke or for the comfort of the user. Alternatively, the thrust receiver may incorporate a swivel joint allow the thrust receiver to freely rotate about 360 degrees. This provision would allow the user complete mobility of the hand or lower extremity as required by the stroke motion.

The thrust receiver is desirably attached to a framework which may constrain the motion of the thrust receiver to a particular axis or in other limitations in response to force exerted by the user. Counterweights may be adapted to the framework in order to reduce any significant gravitational forces opposing a user's thrust. Further, bearings are utilized between movable parts to reduce any frictional forces within the framework that would oppose the user's thrust.

Finally, attached to the framework and directly linked to the thrust receiver is a means to provide movement inertia. Movement inertia may be provided by a flywheel assembly which provides a resistance opposing any change in direction. Additionally, the flywheel assembly is capable of storing the energy exerted by the user and returning the same amount of energy back to the thrust receiver. Another means to provide movement inertia is a piston and an essentially incompressible fluid contained within an endless sleeve or torus. As the piston is moved within the fluid, the fluid develops motion in front of and behind the piston, which tends to keep the piston in motion. An effective coupling between the user and the piston will present the resist/assist feature to the user. The means providing the movement inertia may also have a means to easily adjust the resistance so users of different capabilities may utilize the exerciser.

In many preferred embodiments, the connection between the thrust receiver and the means for movement inertia, for example a flywheel, has the capability to transmit forces in both directions between the thrust receiver and the flywheel. This linkage assembly may contain a combination of chains, sprockets, and a gear train positively connected between the thrust receiver and flywheel. The user exerts a force on the thrust receiver, which is transmitted through the chain, sprocket and gear train assembly. Alternatively, the stored energy within the flywheel may be transmitted through the chain, sprocket and gear train assembly to the thrust receiver.

Alternatively, hydraulic linkage assemblies may be used to transmit forces between the thrust receiver and flywheel. A piston assembly comprising a rod, plunger and incompressible fluid is connected between the thrust receiver and flywheel. The user exerts a force on the thrust receiver which is connected to the rod and plunger. The incompressible fluid is pushed by the plunger through a transmission unit that converts the hydraulic energy to mechanical energy. The transmission unit is coupled with the flywheel which provides the movement inertia. The incompressible fluid may flow in either direction through the transmission unit, thereby being capable of transmitting energy from the flywheel back to the thrust receiver.

The user begins to exercise by initiating an exercise stroke of the apparatus, along a particular stroke path, by transferring energy into the apparatus. This would consist of a push, pull or twist depending on the starting position. The user may then either: continue to transfer energy into the apparatus, which the apparatus will continue to resist, until the end of the initial stroke path; allow the apparatus to assist the user in moving through a segment of the exercise stroke by using the transferred energy within the exerciser; or oppose the motion along the initial stroke path by utilizing opposing muscles to dissipate the energy within the exerciser.

It is an object of this invention to provide a self-contained apparatus for exercising a user's muscles.

It is a further object to provide an exercise apparatus that provides the user with resistance forces created by the use of an essentially weightless mass.

It is a further object to provide an exercise apparatus for equally exercising opposing sets of muscles during an initial exercise stroke.

It is a further object to provide an exercise apparatus that will resist a user induced change in motion along the return stroke path and will assist a user in continuing motion along the return stroke path.

It is a further object to provide an exercise apparatus that overcomes inherent frictional forces as physically possible using current mechanical design. In this manner, the apparatus will resist a user induced change in motion along the return stroke path with an amount of work substantially equal to the amount of work previously exerted by the user during the initial resist stroke.

It is a further object to provide for a stroke path that may encompass three-dimensional motion.

It is an advantage of this invention that gravity does not have a significant effect on the operation of the invention so that the exercise apparatus may be used in a weightless environment.

It is a further advantage that users of various physical capabilities may utilize the invention without making significant mechanical adjustments to the invention.

It is a further advantage that the assist function of the invention may be used to move a user's limb through a difficult or unfamiliar segment of the exercise stroke that the user is incapable of doing alone.

It is a further advantage that the user may safely release from the invention at any time during the exercise stroke if the user becomes disabled for whatever reason or simply wishes to reposition their body or hand grip.

It is a feature of the invention that the coupling between a user utilizing the invention and the means to provide the resist-assist function allows one to be responsive to the other.

One possible embodiment of the invention, adapted to have a stroke in one dimension, comprises handgrips, constrained by a framework to allow only linear movement, which is directly coupled to a plurality of flywheels through sprockets, cable chains and gears. A user may initiate a linear movement of the handgrips, in a particular direction, that is resisted by the rotational inertia of the flywheels. The user may then apply an opposite force against the handgrips in order to stop the linear motion of the thrust receiver, thereby exercising opposing sets of muscles during one exercise stroke of the handgrips. Alternatively, a user could utilize the energy that is stored within the moving flywheel to assist the user in moving the handgrips through a particular segment of the exercise stroke. The user may then either continue the exercise stroke by exerting a force in the same direction of motion or stop the exercise stroke by exerting a force in a direction opposite the motion of the handgrips. The user may initiate a return stoke, reversing the sequence of forces applied in the initial stroke.

An alternate embodiment has a defined rotational stroke motion. It comprises handgrips which are attached to one end of a torsion bar that provides a direct coupling of the handgrips to the flywheel and a framework for positioning the handgrips in a location convenient to a user. This embodiment allows a user to exercise by exerting a rotational force against the rotational inertia of the flywheel to induce rotation of the flywheel. The user may exercise further by exerting an opposite rotational force, than the initial stroke, against the handgrips. This opposite force is opposed by the rotational inertia of the moving flywheels; thereby, exercising two opposing sets of muscles during the exercise strokes. Alternatively, the user could utilize the energy stored within the moving flywheel to assist the user in moving the handgrips through a difficult or unfamiliar segment of the exercise stroke. The assistance is followed by either continued inducement of motion along the initial exercise stroke path by exerting a force in the direction of motion or stopping the motion of the exercise stroke by exerting a force in a direction opposite the motion of the handgrips.

Another embodiment develops a stroke path within a single plane and comprises a combination of the functionality of the two previous embodiments. A user is presented with an exercise stroke that may be linear or rotational or a combination of linear and rotational motion.

Another embodiment is an exerciser without a predetermined exercise stroke path that may be made up of a three-dimensional compound motion. The exerciser comprises handgrips attached to one end of a torsion bar contained within one member of an articulating arm with a flywheel at the opposite end of the arm. The exercise stroke may be a combination of linear and rotational motion of the handgrips. The inertia of the flywheel and the articulated arm elements provide linear and rotational inertia at the handgrips for the user to exercise against or utilize in executing an exercise stroke.

The use of counterbalanced masses (presenting essentially a "weightless" condition to a user) to provide inertia as a means to accomplish the resist/assist function of the invention is illustrative only. It is envisioned that there are other ways to accomplish this same function. Additional representations, but not limiting, include a piston and an essentially incompressible fluid contained within an endless sleeve. As the piston is moved within the fluid, the fluid develops motion in front of and behind the piston, which tends to keep the piston in motion, so that an effective coupling between the user and the piston will present the resist/assist feature to the user. The method of providing a direct coupling to the thrust receiver would be obvious to one of ordinary skill in the mechanical arts when analyzed with respect to the detailed descriptions below.

Alternative embodiments of the invention will be apparent to the reader from the descriptions below.

DETAILED DESCRIPTION

Figure 1:
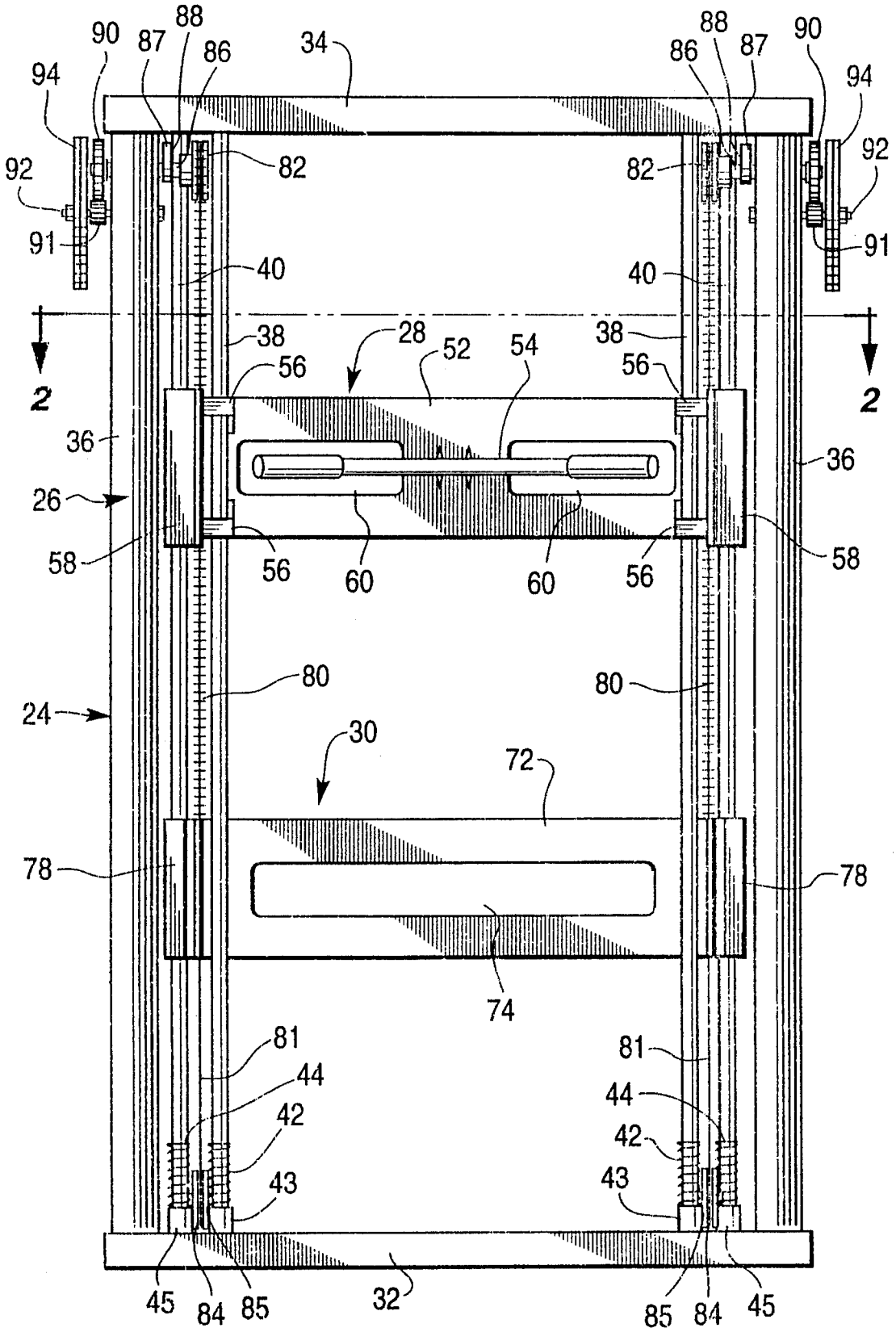
FIG. 1 is a front view of an embodiment of the invention that incorporates a linear exercise stroke.
Figure 4:
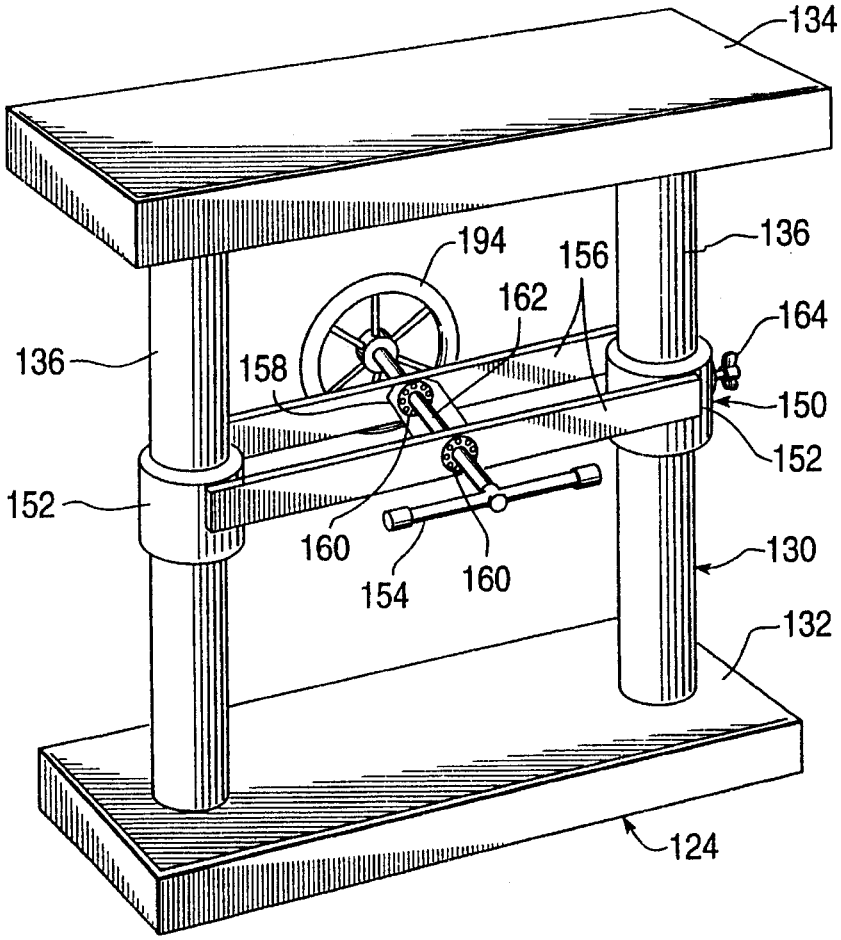
FIG. 4 is a perspective view of an embodiment of the invention that incorporates a rotational exercise stroke.
Figure 5:
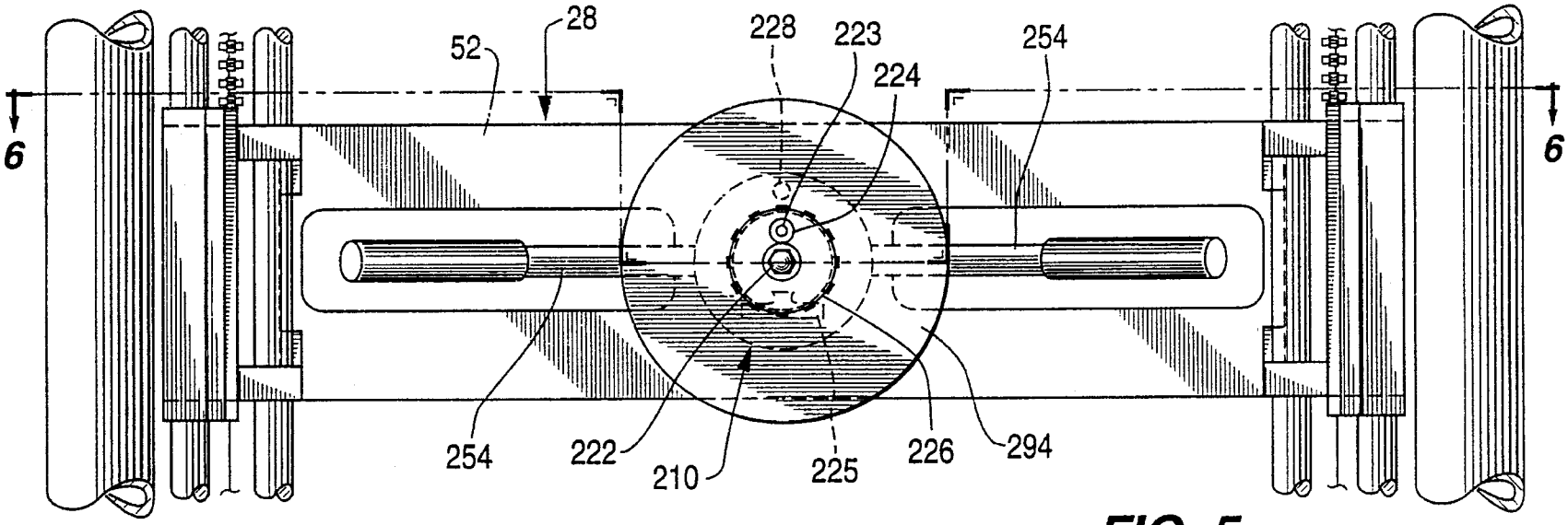
FIG. 5 is a front partial view of another embodiment of the invention that incorporates a compound exercise stroke.
Figure 7:
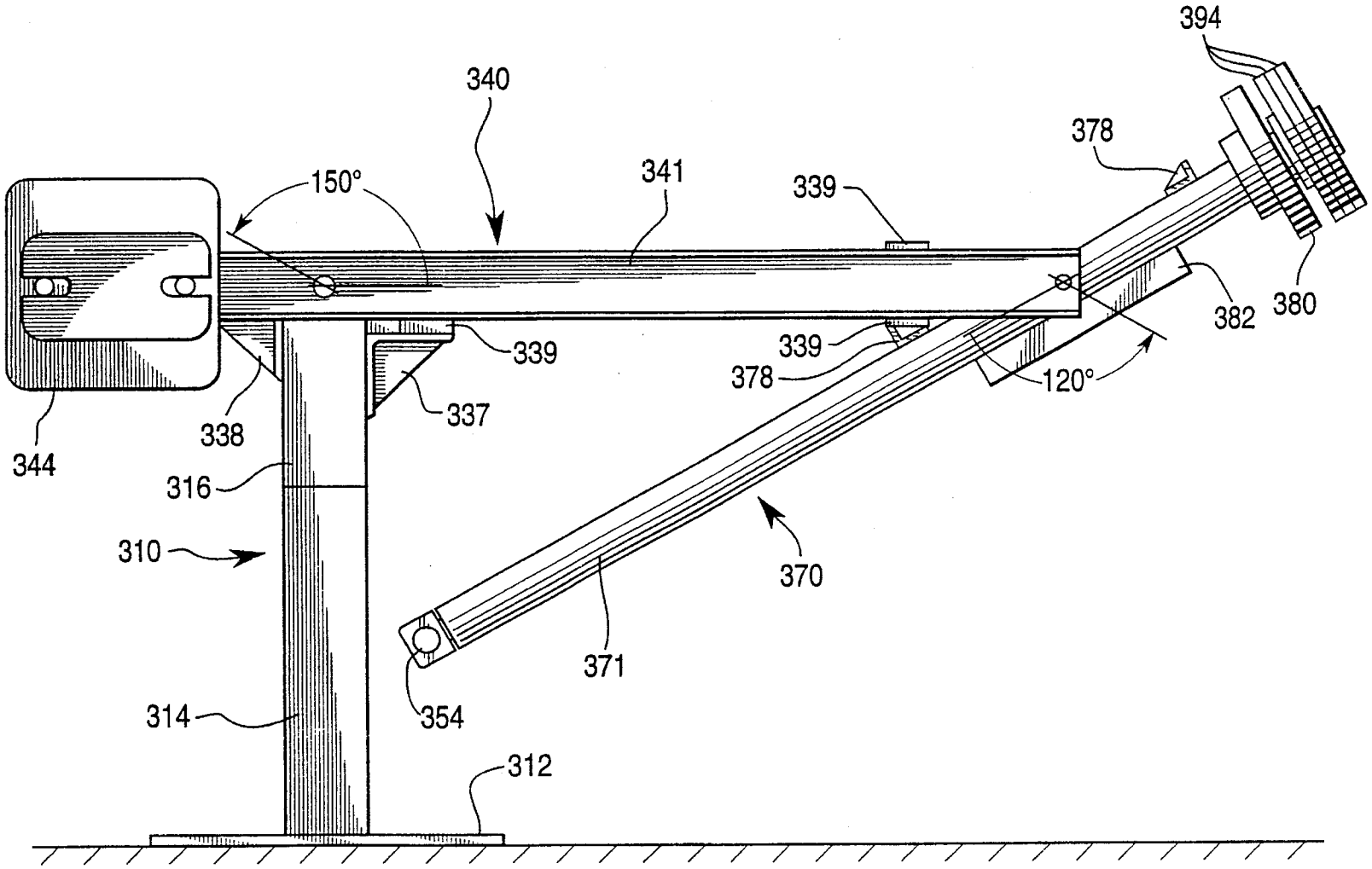
FIG. 7 is a side view of another embodiment of the invention that incorporates a three-dimensional compound exercise stroke.
Figure 8C:
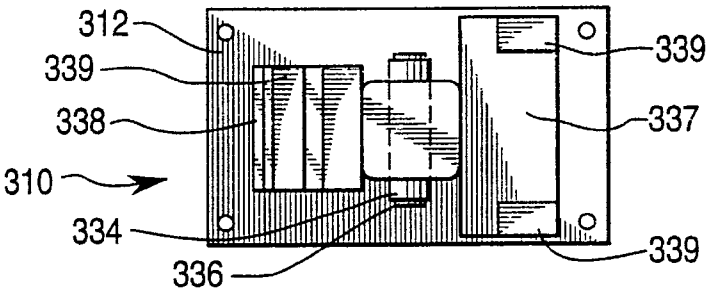
FIG. 8*c* is a plan view of the apparatus shown in FIG. 8.
Figure 8B:
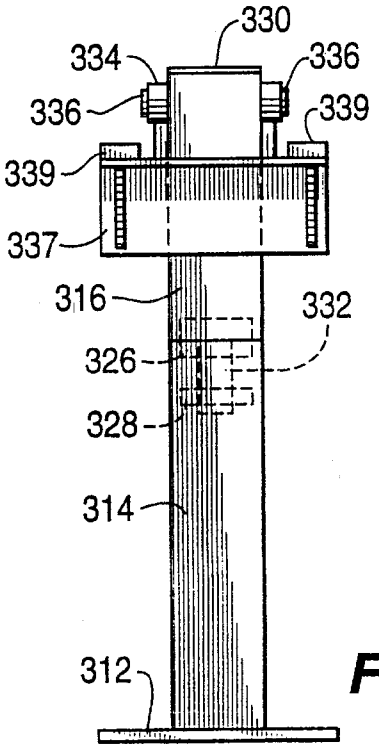
FIGS. 8*a* and 8*b* are alternate elevation drawings of the apparatus shown in FIG. 8.
Figure 8:
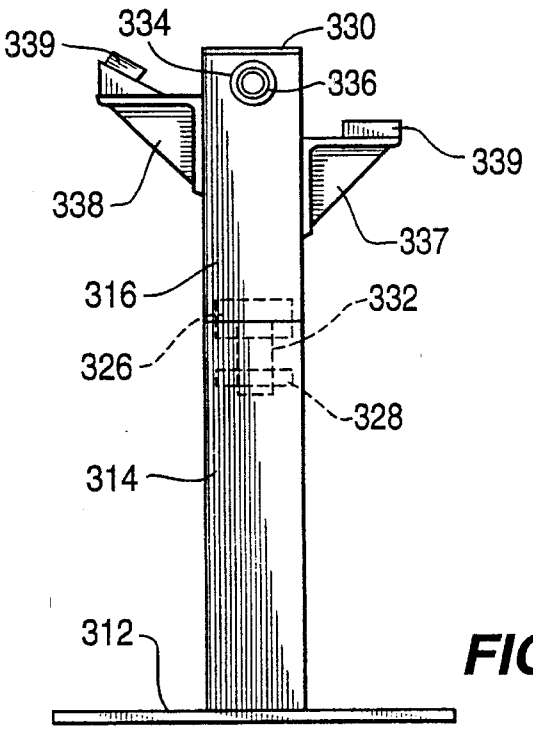
FIG. 8 is an elevation drawing showing the pedestal of the embodiment of FIG. 7.
Figure 8A:
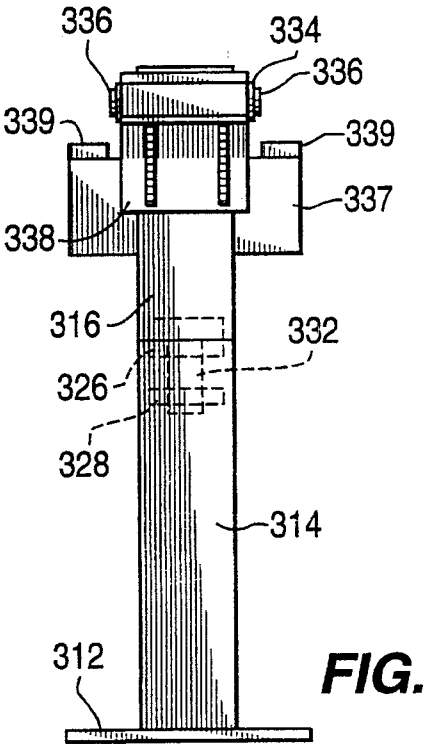

The function of the present invention will be best understood by considering the structure of specific embodiments shown in FIGS. 1, 4, 5 and 7. FIG. 1 illustrates an embodiment which utilizes linear input forces to act against rotational inertia, which provides the resist/assist function. FIG. 4 illustrates an embodiment which utilizes rotational input forces to act against rotational inertia, which provides the resist/assist function. FIG. 5 illustrates an embodiment that combines the functionality of the two previous embodiments into a single embodiment. It may be operated as either of the two previously mentioned embodiments or operated so that the exercise stroke is a compound motion of both. FIG. 7 illustrates an embodiment that utilizes both rotational and linear inertia so the exercise stroke may be a three-dimensional compound motion.

Figure 11A:
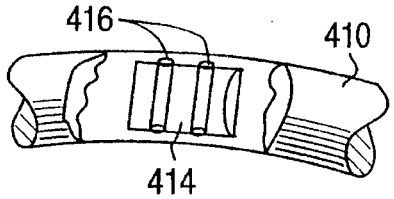
FIG. 11*a* is a cut-away drawing of the apparatus shown in FIG. 11.
Figure 11:
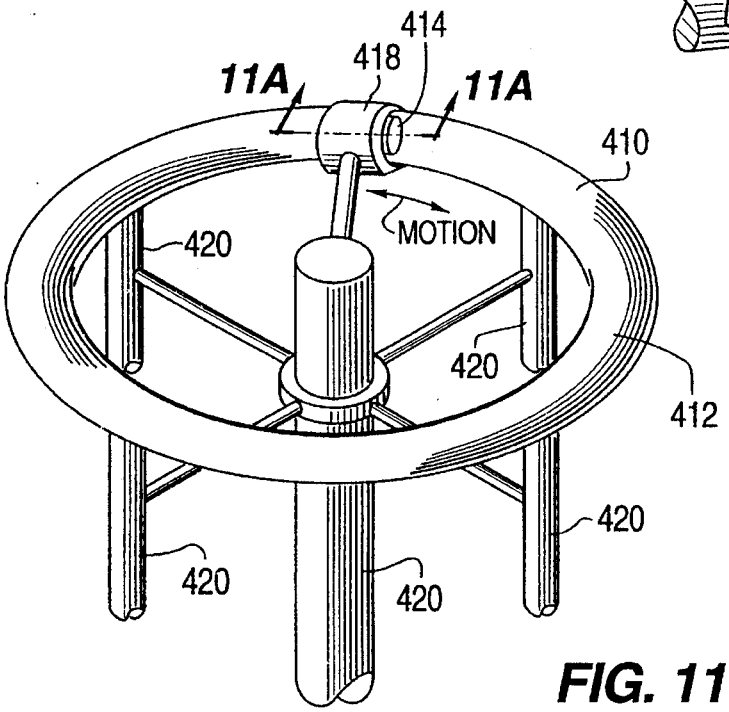
FIG. 11 is a fragmentary perspective drawing of another embodiment of the present invention.
Figure 12:
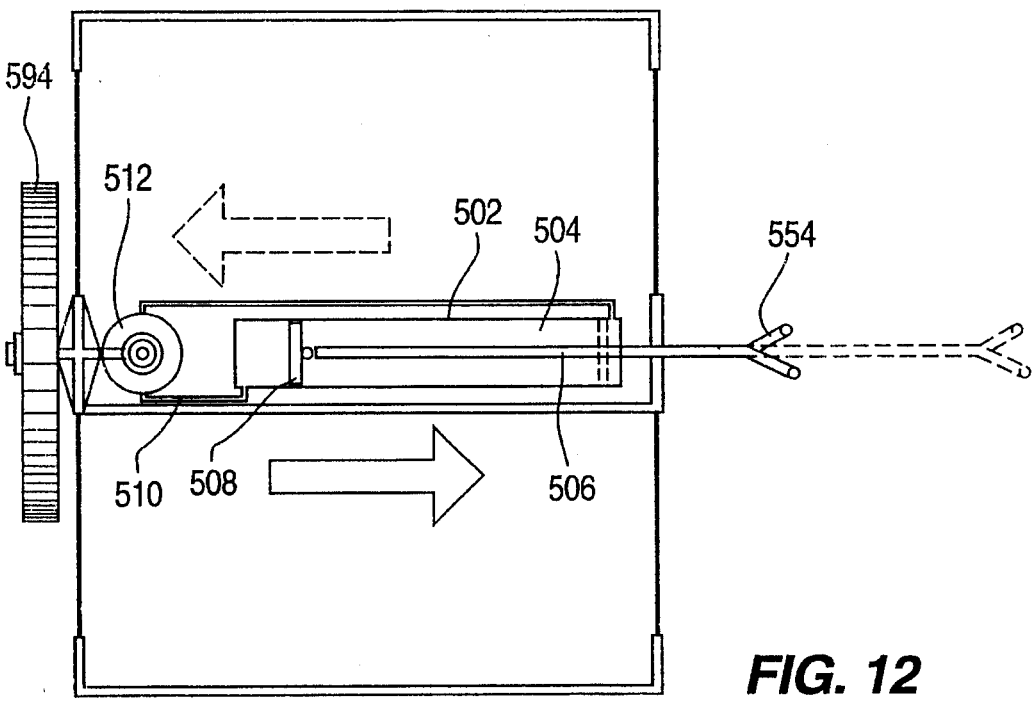
FIG. 12 is an elevation drawing of another embodiment of the present invention.

Also described are alternatives to the inertia of a counterbalanced mass to provide the resist/assist function of the device. An embodiment containing a piston and an incompressible fluid within an endless tube is illustrated in FIG. 11. An embodiment containing a piston and an incompressible fluid within and a flywheel are illustrated in FIG. 12. Representation of a user interacting with the exercise apparatus is illustrated in FIGS. 13, 14, 15 and 16.

Additionally, handgrips are referred to for illustration only. Other conventional means for effecting a coupling to an exerciser are envisioned, and their only requirement is a connection that can both receive and transmit forces.

SIMPLE, SINGLE-PLANE EXERCISE STROKE PATHS

Figure 2:
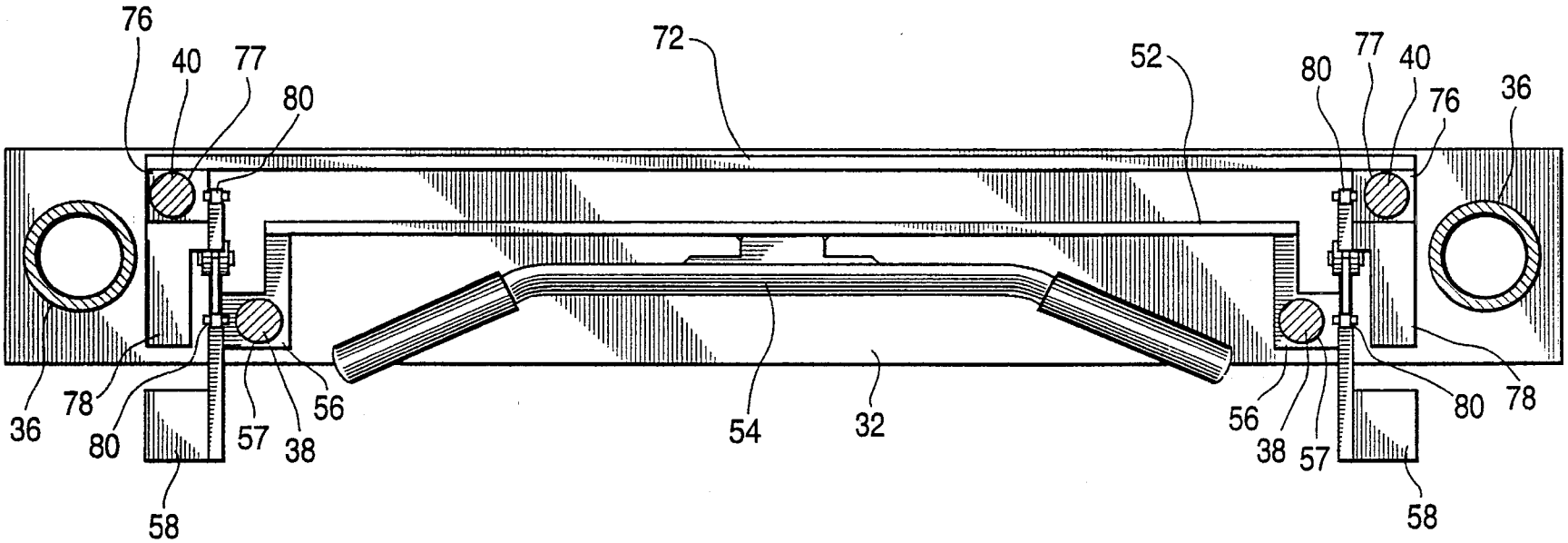
FIG. 2 is a sectional view taken along the line 2—2 of FIG. 1.

The apparatus shown in FIGS. 1 and 2 enables a linear thrust to act against the rotational inertia of the flywheel and the induced rotational inertia that the user transfers into the system by setting the flywheel into motion with the initial thrust. The apparatus 24 is comprised of a framework 26, a carriage assembly 28, a counter-balance assembly 30, and the linkage to the flywheels.

The framework 26 is comprised of a horizontal base 32 and top 34 which are roughly rectangular in shape and approximately in parallel relation, two approximately parallel vertical columns 36, and four parallel vertical guide posts 38 and 40 with their related overtravel springs 42 and 44 and spacers 43 and 45. Typically the guide posts are round but they need not be. The base 32 and the top 34 are firmly connected to the ends of each of the columns 36 and support the ends of the four guide posts 38 and 40. The positioning of the guide posts is roughly symmetrical about the length of the base 32 and top 34, such that the spacing of the center position of guide posts 38 where they meet the base 32 and the top 34 corresponds to the horizontal center position of the linear bearings 57 so that the guide posts form a set of rails for the carriage assembly 28 to travel. Similarly, guide posts 40 are positioned, where they are attached to the base 32 and the top 34, so as to correspond to the center position of the linear bearings 77 of the counter-balance assembly 30. There also must be sufficient spacing between the planes in which the centers of guide posts 38 lie and the centers of guide posts 40 so that the back of the carriage assembly 28 may pass the front of the counterbalance assembly 30 without interference. The carriage assembly overtravel limit springs 42 and the carriage assembly overtravel limit spacers 43 are located at the base 32 and contained on guide posts 38 and are of sufficient length and strength so that when the carriage 28 is moved by the user to the full extent of its travel towards the base 32 the carriage 28 does not come into contact with the base 32 nor does the counterbalance assembly 30 come into contact with the top 34 and any rotational inertia, within the moving flywheels 94 (FIG. 3), may be absorbed by the springs 42. The counterbalance assembly overtravel limit springs 44, which may be the same as carriage assembly overtravel limit springs 42, and the counterbalance assembly overtravel limit spacers 45, which may be the same as carriage assembly overtravel limit spacers 43, are contained on guide posts 40 and have sufficient length and strength that when the carriage 28 is moved by the user to the full extent of its travel towards the top 34 the carriage 28 does not come into contact with the top 34 nor does the counterbalance assembly 30 come into contact with the base 32 and any rotational inertia, within the moving flywheels 94, may be absorbed in the springs 44. The elements recited above are typically made of metal but it is not required so long as they are of a material of sufficient strength to maintain the integrity of the apparatus.

The carriage assembly 28 comprises a carriage plate 52 which is typically rectangular in shape, but other shapes may be used, with a thickness considerably less than its length or width. Handgrips 54 are securely attached, roughly in the center of the one side of the carriage plate 52, so that the handles extend opposite the side that the counterbalance assembly 30 will pass. The carriage guide blocks 56 contain linear bearings 57 and are securely attached to one side of the carriage plate 52 approximately at its corners in such a way that the coaxial centers of a pair of linear bearings 57 are in line with each other and parallel to the similarly aligned centers of the other pair of linear bearings 57. The linear bearings 57 may be any type provided that they minimize the frictional effect on a movement of the carriage assembly 28 along the guide rods. Extending to the opposite side of the linear bearings on the carriage plate 52 are counterweights 58 which are typically located opposite the guide blocks 56 and are located in such a way and are of such a size as to counter any torque placed on the linear bearings 57 by the weight of the other elements comprising carriage assembly 28. The carriage plate 52 may have cutouts 60 in order to reduce the carriage plate's 52 weight. The cutouts 60 may be positioned approximately behind the gripping location of the handgrips 54 to allow for easier gripping by the user. The material of the carriage assembly typically would be metal but it is not required.

The counterbalance assembly 30 comprises a counterbalance plate 72, a counter balance cutout 74, counterbalance guide blocks 76 containing linear bearings 77 and counterbalance counterweights 78. The counterbalance guide blocks 76, the linear bearings 77 and the counterbalance counterweights 78 serve a similar purpose in this assembly as the corresponding elements of the carriage assembly 28 and are thus similarly sized and positioned in reference to guide posts 40. The counterbalance plate 72 and the counterbalance cutout 74 are selected and sized in order that the weight of the counterbalance assembly 30 closely approximates the weight of the carriage assembly 28. This is done so that the user is not subjected to any significant forces, when utilizing the device, other than the inertial resist/assist forces provided by the counterbalanced masses. The material of the elements of the counterbalance assembly 30 would also be metal but it is not required and it is envisioned that a composite or plastic capable of meeting the forces the counterbalance assembly 30 would be subjected could be utilized.

The carriage assembly 28 and the counterbalance assembly 30 are connected by two sprocket chains 80 of equal length, that are capable of engaging a sprocket in a no-slip connection, and two equal lengths of cable 81. Both the sprocket chains 80 and cables 81 are of such length to allow maximum travel of the carriage assembly 28 without interference with the other elements of the apparatus 24. One end of chain 80 is securely attached to the top carriage guide block 56 and the other corresponding end of chain 80 is securely attached to the corresponding top counterbalance guide block 76 after passing over sprocket 82. One end of the other length of chain 80 is securely connected to the alternate top carriage guide block 56 and the other corresponding end of chain 80 is securely attached to the corresponding top counterbalance guide block 76 after passing over sprocket 82. Sprockets 82 must be capable of gripping the chains 80 with no slippage.

One end of cable 81 is securely attached to the bottom carriage guide block 56 and the corresponding bottom counterbalance guideblock 76 after passing under pulley 84. One end of the other length of cable 81 is securely attached to the alternate bottom carriage guide block 56 and the other corresponding end of cable 81 is securely attached to the corresponding bottom counterbalance guide block 76 after passing under pulley 84. Pulleys 84 may be any type provided they are capable of changing the direction of the cable by approximately 180 degrees while imparting minimal drag into the system. Additionally the pulley diameter should be less than or approximately equal to the horizontal distance separating the carriage assembly 28 and the counterbalance assembly 30. The pulleys 84 are connected to the apparatus at the base 32 with brackets 85 but may be connected elsewhere towards the bottom of the apparatus.

Sprockets 82 are securely connected to shafts 86 so that the shaft turns as the sprocket turns. The shafts are supported with bearings 87 which may be contained in brackets 88 securely mounted to the framework 26 or alternatively, within some piece of the framework 26 itself. Also securely attached to shaft 86 are gears 90. Gear 90 is directly engaged with gear 91 which is mounted on axle 92 in such a way as to have the rotational motion of the gears be directly proportional to the rotational motion of the flywheels 94 that are also mounted on axle 92. The gears are selected so that the linear velocity of the handgrips 54 is proportionately converted into a rotational inertial velocity of the flywheels 94. An alternate embodiment is that some form of a gear box could be installed in place of the fixed gears so that a user could vary the proportion of the velocity of the handgrips to the velocity of the flywheels.

Figure 3:
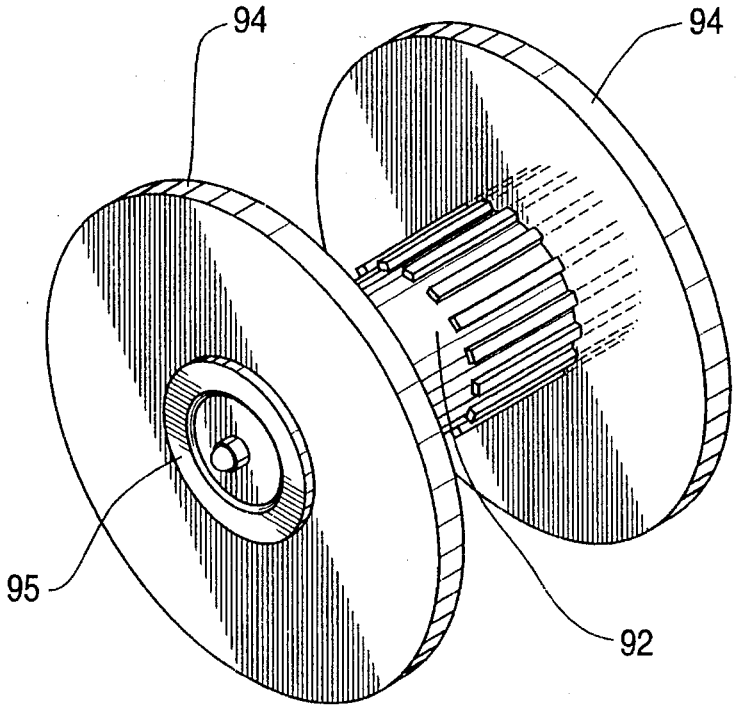
FIG. 3 is a perspective view of an inertial element embodying means to adjust the amount of inertia.

It is envisioned that a user might wish to vary the amount of counterbalanced mass providing the inertia to the system. This is illustrated in FIG. 3 by adapting the axle 92 and the flywheels 94 with a complementary spline on each and a containment flange 95 attached to the outer end of the axle 92. The axle 92 could have the spline on approximately half of its length so that flywheels 94 not in use are simply disengaged from the axle 92 spline but remain on the axle 92 contained by the containment flange 95. FIG. 3 shows two flywheels 94 on axle 92 one of which is in the engaged position while the other is in the disengaged position and kept on the axle by the containment flange 95.

A user of the embodiment illustrated in FIG. 1 will utilize the device by gripping the handgrips 54 and exerting an upward or downward linear thrust upon them, resulting in an exercise stroke. The movement of the handgrips causes the flywheels 94 to rotate as the cable chains 80 pass over sprockets 82 which are directly connected to the flywheels 94 by gears 90 and 91. As the user accelerates the handgrips 54 the user must overcome the rotational inertia of the flywheels 94. In order to stop the motion of the handgrips 54, which would continue in the same direction the user initiated due to the imparted rotational inertia in the moving flywheels 94, the user must exert an opposite force in order to bring the handgrips 54 to a stop. The user could also make use of the rotational inertia of the moving flywheels by allowing it to assist the user in moving through a segment of the exercise stroke. The user now may accelerate the handgrips in the opposite direction, which will be resisted by the rotational inertia of the stationary flywheels 94, in order to return the handle bars to their original starting position. But once started in the return direction the user again must exert a force against the handle bars in order to stop them at the original starting point, thus completing a cycle. The counterbalance assembly 30 and the bearings used throughout the apparatus allow the resistance transmitted to the user through the handle bars to approach as near as possible only that of the rotational inertia of the flywheels 94.

The apparatus shown in FIG. 4 enables a rotational torque to act against the rotational inertia of the flywheel and the induced rotational inertia that the user has transferred into the device. The apparatus 124 is comprised of framework 130, a torsion bar 162, handgrips 154, and flywheel 194.

The framework 130 is comprised of a horizontal rectangular base 132, that could be attached to the floor or other solid surface, a top 134, that is essentially the same as the base 132 and located parallel to and above the base 132. The top 134 and base 132 are connected together by two posts 136 that are located near the ends of the long dimension and approximately centered with respect to the shorter distance of the rectangular base 132 and top 134.

The torsion bar assembly 150 is movably attached to the posts 136 so that an exercising user may select an exercise position. The torsion bar assembly 150 comprises two collars 152 which are slideably mounted on posts 136. The two collars 152 are connected by two parallel rectangular plates 156, one of which is securely attached to one side of the collars 152 while the other plate is securely attached to the other side so that they face each other and are approximately in line with each other. A cylindrical bearing housing 158 passes through the faces of each of the plates 156 at their approximate centers. The bearing housing 158 is of a length that has the ends approximately flush with the outwardly facing surfaces of the plates 156. Contained at each end of the bearing housing 158 are bearings 160 sized to carry a torsion bar 162 and allow minimal frictional drag on the rotation of the torsion bar 162. The torsion bar 162 is contained within the bearings in a way that allows only rotational motion. There are numerous methods to accomplish this such as press-fitting or free-fitting the torsion bar to the bearing 160; other methods would be apparent to one of ordinary skill in the mechanical arts. Additionally, the assembly is adapted to have a way of locking the assembly in place along the posts 136. In one embodiment this function is accomplished by a locking screw 164 that passes through a threaded hole in one of the collars 152 in order to tighten against a post 136. It is envisioned there are other methods to accomplish this same goal and these other methods are apparent to one of ordinary skill.

Securely attached to one end of the torsion bar are handgrips 154. Removably, but securely, attached to the other end of the torsion bar 162 is at least one (1) flywheel 194.

A user would utilize this embodiment by gripping the hand grips 154 and applying a rotational force about the torsion bar 162. This force is opposed by the rotational inertia of the flywheel 194. Once overcome, the flywheel 194 and the handgrips 154 will begin to move together due to the direct coupling provided by the torsion bar 162. The user may either utilize the energy transferred into the apparatus to exercise a different set of muscles against the rotational inertia of the moving flywheel by exerting a force against the motion of the handgrips 154 thereby exercising two opposing sets of muscles in one exercise stroke. Alternatively, the user may utilize the energy within the moving flywheel allowing the rotational inertia in the flywheel assist the user through a particular segment of the rotational exercise stroke. The user may then reverse the direction of the exercise stroke and return the handgrips 154 to the starting position.

COMPOUND SINGLE-PLANE EXERCISE STROKE PATHS

Figure 6:
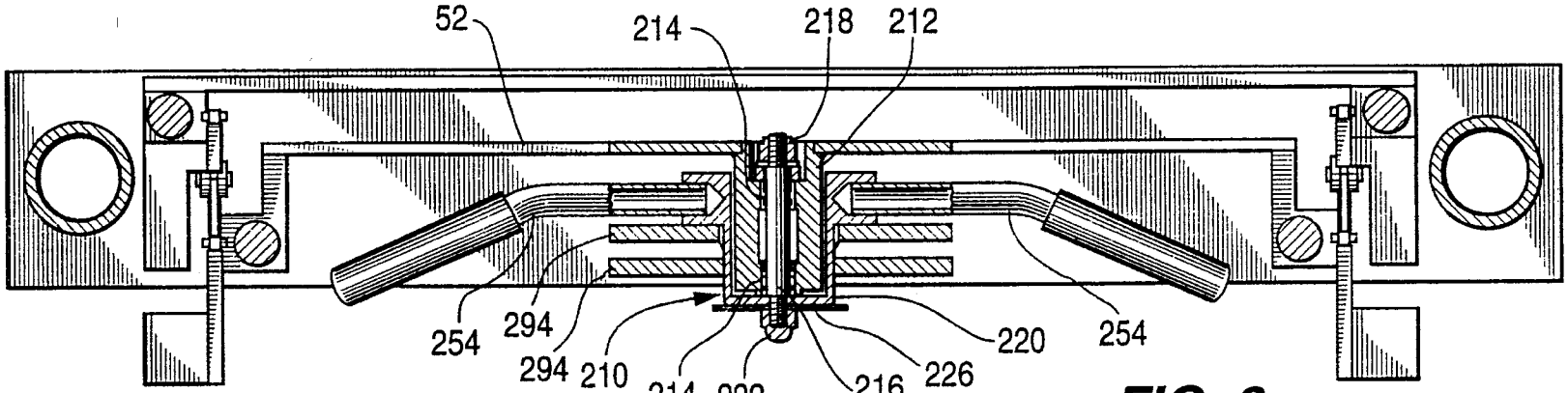
FIG. 6 is a sectional view taken along the line 6—6 of the embodiment in FIG. 5.

In still another embodiment, illustrated in FIG. 5 and FIG. 6, the functionality of the aforementioned embodiments has been incorporated into a single apparatus. This embodiment provides the user with the ability to move the handgrips through an exercise stroke that is a combination of linear and rotational motion thereby increasing the number of muscles that are affected during an exercise stroke. This embodiment uses the same basic apparatus as the embodiment in FIG. 1 with the addition of the mechanism illustrated in FIG. 4 that connects the handgrips 154 to the flywheel 194. It is this mechanism that allows the user to select between simple and compound single-plane exercise stroke paths.

The rotational input mechanism 210 comprises a hollow post 212 that is securely attached, approximately in the center, to the carriage assembly plate 52. The hollow post 212 is of a large enough outside diameter to have a hole through its length, on center, of sufficiently large diameter to contain bearings 214 which may be of any type provided that they transfer minimal frictional drag into the system. The outside diameter of hollow post 212 must also be large enough to allow an off-center locking-pin opening 223 to be located in the face of the post, opposite the face secured to the carriage assembly plate 52, with the proper amount of material left between the locking pin hole and the edge of the center hole and the outside diameter of the hollow post 212 that good engineering requires. Contained in bearings 214 is shaft 216 that is of proper diameter for the bearings 214 and threaded at both ends. At the back end of the shaft, a nut and washer 218 is installed to keep the shaft 216 firmly in position with the bearings 214. At the front end of shaft 216 is an inertia-input housing 220 which is attached to the shaft 216 by a means of captivating the inertia-input housing 220 on the shaft 216 concentrically with hollow post 212 and shaft 216, with what may be a self locking crown nut 222. The inertia-input housing 220 comprises a cylindrical housing with a flange at the open end of sufficient width to allow circumferentially drilled holes for the installation of handgrips 254 approximately 180 degrees apart. The main cavity of the input-inertia housing 220 is of sufficient diameter to allow passing over hollow post 212 without interference and is of sufficient depth so that the flywheels 294 are located in a way that has their centers of gravity between the planes that are created by the front face of hollow post 212 and the front face of the flange of the inertia-input housing 220 that also faces the user. The outside of this housing may have the splined embodiment illustrated in FIG.3 of the embodiment of FIG.1 in order to vary the amount of resistance, in the form of inertia, the user encounters without removing the weight from the apparatus. The inertia-input housing 220 has a through hole at the bottom of the main cavity of a diameter that allows the housing 220 to be captivated upon shaft 216 and rotate freely without interference from hollow post 212. There also is a opening 225 at the bottom of the cavity of a diameter and size that will allow a locking pin 224 to pass through this opening and into the locking pin opening 223 in hollow post 212 to immobilize the rotation of inertia-input housing 220 when the locking pin 224 is engaged. On the side of the flange that faces the carriage assembly plate 52 is a securely attached stop 226 which may be located 180 degrees from the locking pin clearance hole. Securely attached to the carriage assembly plate 52 is a stop pin 228 positioned so that the inertia-input housing 220 may approach but not reach 180 degrees of rotation in either direction from its engaged position.

A user of the apparatus may engage the locking pin 224, which connects the housing 220, and therefore the handgrips 254, to the stationary hollow post 212 thereby preventing any rotational movement of the handgrips 254. In this configuration the user would operate the apparatus in a manner similar to the embodiment of FIG.1. If the user disengages locking pin 224, the user now may apply rotational forces to the handgrips 254 since the housing is now free to rotate on the bearings 214. The handle bars 254 and the flywheels 294 are securely attached to the flange of the inertia-input housing 220 and so are the flywheels 294, the two are directly coupled. In this configuration the user would operate the apparatus in a manner similar to the embodiment shown in FIG.4. The user may also operate this embodiment through a compound single-plane exercise stroke that involves simultaneous linear motion of the carriage assembly 28, which is resisted and assisted by the rotational inertia of the flywheels 94, while executing a rotational motion of the handgrips 254, which is resisted and assisted by the rotational inertia of flywheels 294.

THREE-DIMENSIONAL COMPOUND EXERCISE STROKE PATHS

In another embodiment, illustrated in FIGS. 7,8,9, and 10, the apparatus comprises a Pedestal 310, a secondary arm 340, and a primary arm 370. This embodiment is designed to allow the user to exercise through the use of a compound exercise stroke that occurs up to three-dimensions. The rotary motion of the handgrips is resisted and assisted by rotational inertia of a movable flywheel, and the inertia incorporated into the arms provide additional inertial resistance to rotational or linear motion of the handgrips.

As shown in FIG. 7 the pedestal 310 comprises a horizontal base 312, a vertical lower post 314, a vertical upper post 316, two stops 337 and 338, elastomer stop pads 339, and two bearings 336, inside a tube 334, that will support the secondary arm 340. The base 312 may be a rectangular plate of steel that is capable of being mounted to the floor or other surfaces. Attached, roughly in the center of and approximately perpendicular to the base 312, is one end of the lower post 314 which may be made out of a section of steel tubing. At the opposite end of the lower post 314 than base 312 are two bearings 326 and 328 that are contained within the lower post 314. These bearings are of a type and size that will support the weight of the upper post 316, the primary arm 370 and the secondary arm 340 while inducing minimal drag to the apparatus when the upper post 316 is rotated with respect to the stationary lower post 314. The upper post 316 may also be made from steel tubing to which a cap plate 330, of a size approximately equal to the cross-sectional dimensions of the outside of the upper post 316, is securely attached to the end opposite the base 312 so that it covers the opening at the end of the upper post 316. At the end of the upper post 316 that faces the base 312 is a pin 332 that engages the bearings 326 and 328. This pin 332 is securely attached to the upper post 316 and adapted to fit within the bearings 326 and 328 in order that the load of the rest of the exercise apparatus may be transferred to the base 312 by way of the lower post 314. At the opposite end of the upper post 316 than the pin 332 is a tube 334 which is securely attached and horizontally positioned (in one preferred embodiment) at a distance of 33 inches from the bottom of the base 312 to the center line of the tube 334 in such a way that it passes perpendicularly through the faces of the upper post 316, approximately at the horizontal center of the upper post 316 and approximately parallel with the base 312. The tube 334 encloses two bearings 336 that will support the secondary arm 340 with minimal drag. Securely mounted to the upper post 316, at the same end as the tube 334, are stops 337 and 338. These stops are positioned in relation to the vertical centerline of the upper tube 316 so that stop 337 will hold the secondary arm 340 in a horizontal position and stop 338 will allow the secondary arm approximately 150 degrees of movement (in FIG. 7 the movement would be in the counterclockwise direction). The elements mentioned above may be made out of steel or any other appropriate material. Elastomer stop pads 339 may be attached to the stops at the point of contact with the secondary arm 340.

Figure 9A:
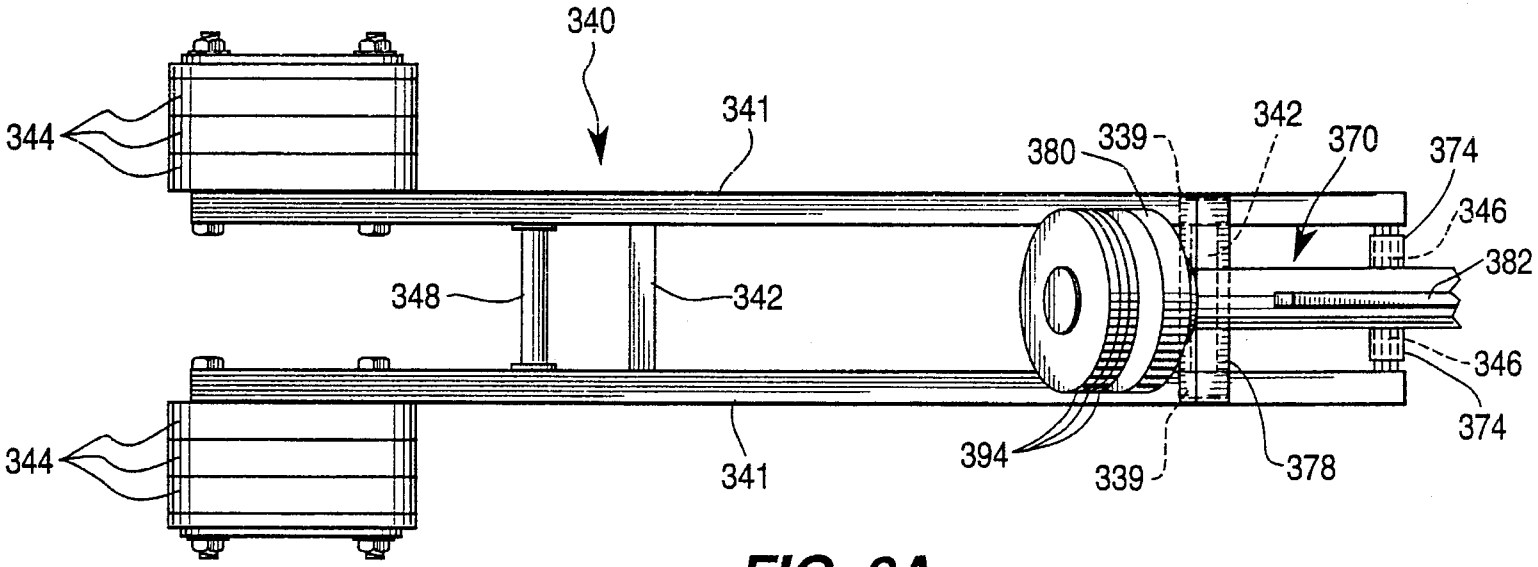
FIG. 9*a* is a plan view of the apparatus shown in FIG. 9.
Figure 9:
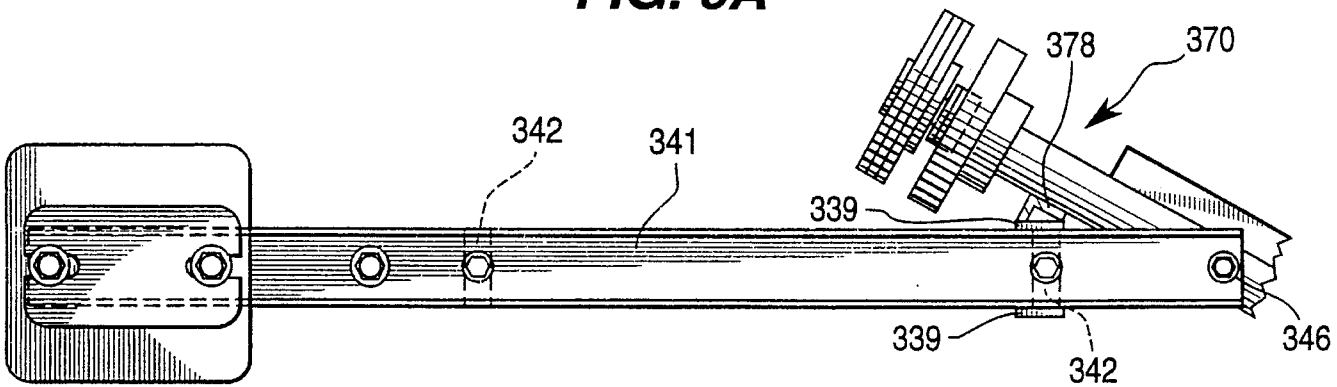
FIG. 9 is an elevation drawing of the secondary arm of the embodiment of FIG. 7.
Figure 10C:
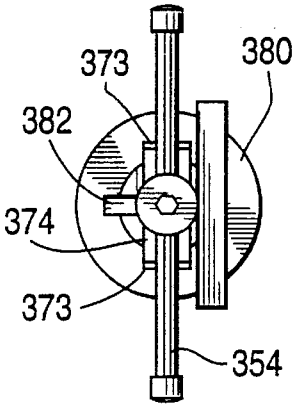
FIGS. 10*a* and 10*c* are cut-away drawings of the apparatus shown in FIG. 10.
Figure 10A:
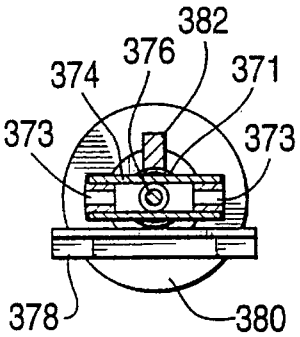
Figure 10B:
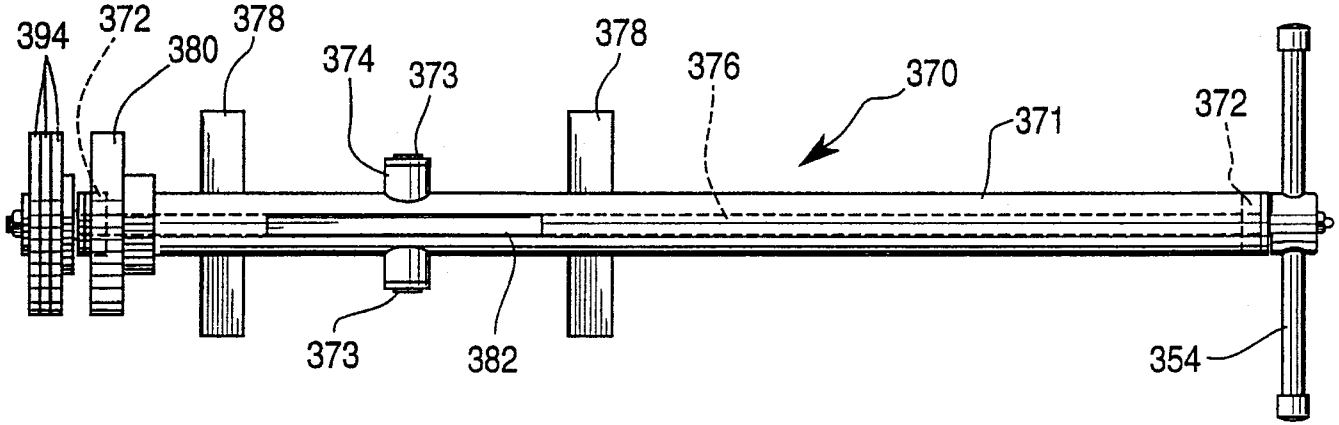
FIG. 10*b* is a plan view of the apparatus shown in FIG. 10.
Figure 10:
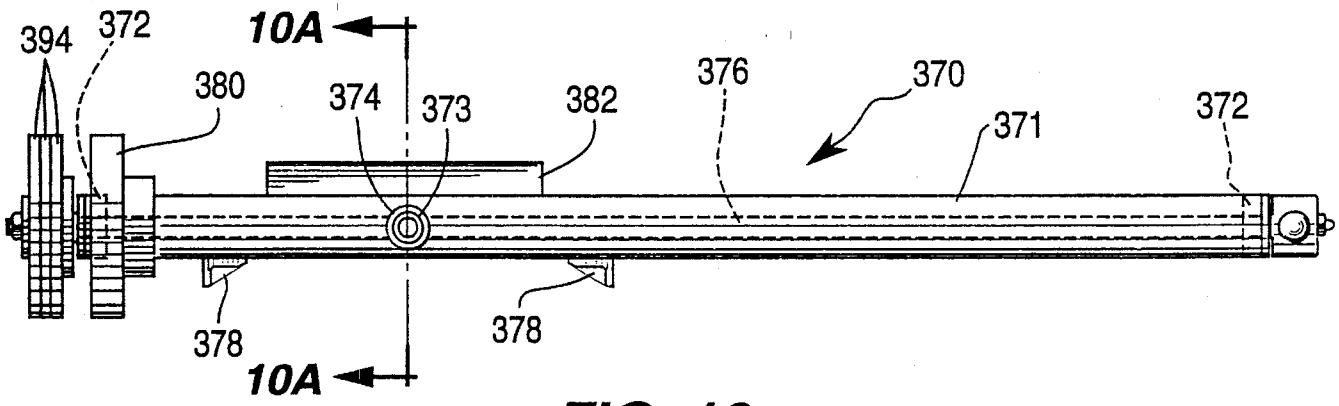
FIG. 10 is an elevation drawing of the primary arm of the embodiment of FIG. 7.

As shown in FIG. 9, the secondary arm 340 comprises two parallel rails 341 that are positioned opposite each other in a horizontal plane and maintained in position by rail separators 342. The rail separators 342 may be rectangular blocks that are removably secured to each of the rails 341 and one may be located at the point of contact with the stops 337 and 338 while the other may be located at the point of contact with the primary arm stops 378. The rail separators 342 are of a length sufficient to allow the rails 341 to pass the upper post 316 without interference. Attached to one end of the rails 341 are counterweights 344 and at the other end of the rails 341 are pins 346 for connecting the primary arm 370 to the secondary arm 340. The two pins 346 are securely attached and face inward (towards the opposite rail), one originating from each of the rails 341. The centers of these pins 346 are concentric and the sizes are such that they are capable of engaging the bearings 373 in the tube 374 of the primary arm 370. The secondary arm 340 further comprises a pedestal mounting pin 348 that is of a diameter proper to mate with the bearings 336 in the pedestal 310 and which has a length sufficient to span the distance between the two rails 341. The pedestal mounting pin 348 is located along the rails 341 between the counterweights 344 and the locating pins 346 (in the preferred embodiment of FIG. 7, approximately 42 inches from the centerline of the locating pins 346 and symmetrical to the width of the rails). The total amount of counterweight used should be an amount so that when the primary arm 370 is attached at the locating pins 346, the secondary arm 340 will be horizontally balanced about the pedestal mounting pin 348. The counterweights 344 may be mounted on each of the rails 341. Elastomer stop pads 339 may be attached where the primary arm stops 378 make contact with the secondary arm 340. The material used for the above elements may be metal, but it is envisioned that a plastic or composite might be acceptable, in solid, tubular or channel form per generally accepted design standards.

The primary arm 370 comprises a tubular housing 371 which may contain bearings 372 mounted in each end concentrically with the centerline of the tube, a means of containing the two bearings 373, which may comprise a tube 374 which would pass perpendicularly through and symmetrical with the long axis of the housing 371 and be securely attached to the housing while containing clearance to allow the torsion bar 376, within housing 371, to pass without interference. The two bearings 373 engage the locating pins 346 to allow the primary arm 370 to rotate about the secondary arm 340. A reinforcing bar 382 may be securely attached to the outside of the tubular housing 371 where the tube 374 passes through. In addition, there are two primary arm stops 378 that are securely attached to the tubular housing 371 in such a way to stop the rotational motion of the arm about the locating pins 346 at approximately 30 degrees to the secondary arm 340, thus allowing approximately 120 degrees of motion with respect to the secondary arm's length as illustrated in FIG. 7. The primary arm further comprises a torsion bar 376 that is contained within bearings 372, to which removably, but securely, attached to one end is a flywheel 394, and removably but securely attached to the other end are handgrips 354 so that there is no meaningful slippage between them and the rotation of the flywheel 394. Also attached to the housing 371 is a counterweight 380 that enables the primary arm 370 to be balanced about the axis made up by the centers of bearings 373. The primary arm 370 is positioned on the secondary arm 340 in such a way as to have the flywheel 394 above the longitudinal (horizontal) centerline of the secondary arm 340. The primary arm 370 is balanced about the locating pins 346, and the secondary arm 340, supporting the primary arm 370, is also balanced about its pivot pin 348. This doubly balanced arrangement provides only inertial resistance for the restricted rotations of the arms 340 and 370. If the user requires additional inertial resistance than that provided by the balanced arms, additional flywheels (not shown) may be added onto the primary and secondary arms. Dimensions should be chosen so that after the flywheels are added onto the arms, the arms are balanced about their respective pivot points. The elements of the primary arm may be, but do not have to be made of metal.

An alternative method of construction of this embodiment would be to manufacture the elements that make up the apparatus out of tubing, either plastic or metallic, with closed ends and further adapted to have a provision for filling the tubular elements with ballast, for example water or sand. This embodiment would allow the shipping weight of the apparatus to be kept at a minimum, ease the installation of the apparatus, and possibly reduce the cost of manufacture, while still supplying the inertia needed for the resist-assist function of the apparatus.

A user of this embodiment will be able to select numerous exercise positions, from standing up to lying down, due to the linkage of the primary arm 370 to the secondary arm 340 and the pedestal 310, allowing various muscle groups to be exercised. The user will further be able to utilize a three-dimensional, compound exercise stroke that also provides flexibility to various muscle groups. The user will position the handgrips 354 and start the motion along an exercise stroke path by exerting a force on the handgrips which is resisted by the rotational inertia of the flywheel 394 and the inertia of the balanced masses of the arms 340 and 370 (and any additional flywheels attached to the arms), both of which are overcome by the user as movement is induced. A user must now work against the imparted energy by exerting a force against the inertia in the moving elements of the apparatus in order to stop their motion and the motion of the handgrips 354. A user may then reverse the direction of the stroke path in order to return the thrust receiver to its starting position or follow an altogether different path back to the starting position. A user again must overcome the inertia of the balanced elements and then stop the moving elements at their original starting position by overcoming the inertia of the moving elements. A user may alternatively utilize the inertia of the moving elements to assist motion along an exercise stroke path segment where the user does not have sufficient strength or freedom of motion to continue exerting force into the apparatus. The user may also use the inertia of the moving elements at the end of the exercise stroke to stretch the user's muscles along the stroke path; whereby the users muscles dissipate the energy of the moving elements.

FURTHER WAYS TO SUPPLY THE RESIST-ASSIST FUNCTION

The following are meant to be representative and not to be limiting methods of supplying the resist-assist function to the user.

The embodiment shown in FIG. 11 of the resist-assist function has a piston contained within an endless cylinder, shaped as a torus, that is filled with an essentially incompressible fluid. A means exists to drive the piston around the inside of the cylinder thereby creating a continuous current that will tend to keep the piston in motion. The embodiment comprises a cylinder 410 which is filled with an incompressible fluid 412 and contains a piston 414 which is surrounded by a plurality of rings 416 (which could be "0"-rings) that are designed to prevent leakage of the fluid 412 between the cylinder wall and the piston. The piston is made from a magnetic material. The piston is driven by rotatory motion of a "C"-shaped collar 418 that has an magnetic field sufficient to grab and move the piston 414 that is inside the cylinder 410 and move it in conjunction with the rotary motion of the collar 418. The collar 418 is oriented so that the open part of the "C" passes the supports 420 needed to carry the cylinder 410.

This embodiment is activated by a rotational input created from the user's induced movement of the apparatus elements, that is transferred to the collar 418 through conventional methods, which causes the collar 418 to travel around the outside of the cylinder 410 in a circular path. The magnetic field set up within the collar 418 is sufficiently strong to grip the piston 414 when the collar 418 passes over it. Once the piston 414 has been gripped by the magnetic field the stationary fluid 412 within the cylinder 410 will resist the movement of the piston 414, thereby providing resistance to the user. Once the fluid is in motion within the cylinder 410 the motion of the fluid will tend to keep the piston in motion by carrying it within the current that is set up. This is transferred back to the user through the magnetic field and the "C" collar, thereby providing the resist-assist function of the invention.

FIG. 12 represents another possible embodiment of the resist/assist function using an incompressible fluid. The embodiment comprises handgrips 554 in communication with a piston 502. Attached to the handgrips is a rod 506 and plunger 508 contained within an incompressible fluid 504. The plunger 508 is designed so that fluid will not flow between the plunger 508 and the piston wall. As the rod 506 and plunger 508 are moved within the piston 502, fluid is forced through the tubes 510 through the hydraulic to mechanical transmission unit 512. The transmission unit 512 converts the energy within the moving fluid to rotating mechanical energy which is used to overcome the inertia of the flywheel 594.

A user of the embodiment illustrated in FIG. 12 will utilize the device by gripping the handgrips 554 and exerting a linear push force from position I (defined by the dotted lines in FIG. 12) to position II (defined by the solid lines in FIG. 12) or a linear pull force from position II to position I. The movement of the handgrips causes the fluid to move within the piston 502 and the tubes 510 in the direction of the arrows corresponding to a push or pull force. For example, if the user begins in position I and pushes towards position II, the fluid will flow in the direction of the dotted arrow. The flow of the fluid 504 causes the flywheel 594 to rotate as the user overcomes the rotational inertia of the flywheel 594. In order to stop the motion of the handgrips 554, which would continue in the same direction the user initiated due to the imparted rotational inertia in the moving flywheel 594, the user must exert an opposite force in order to bring the handgrips 554 to a stop. In this manner, the user has exercised opposing sets of muscles within one stroke of the apparatus. The user could also make use of the rotational inertia of the flywheel 594 by allowing it to assist the user through a segment of the exercise stroke. As the user pulls the handgrips 554 from position II to position I, the fluid 504 will reverse flow direction as shown by the solid arrow and cause the flywheel 594 to reverse direction. Again, the user must overcome the rotational inertia of the flywheel 594 to bring the handgrips 554 to rest or allow the rotational inertia assist the user through a segment of the stroke. The push-pull sequence may be repeated as often as desired.

EXAMPLES OF USING THE RESIST/ASSIST APPARATUS

The following examples of using the resist/assist apparatus are for illustrative purposes only and are not intended to limit the potential uses of the apparatus.

Figure 13:
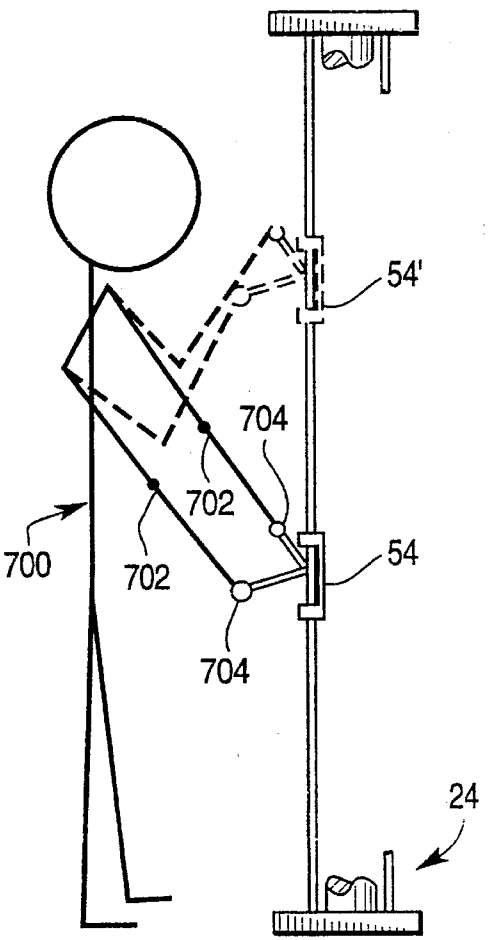
FIG. 13 is a side view of a user, represented by a stick figure, utilizing a partially illustrated embodiment of the invention that is shown in FIG. 1.

FIG. 13 shows a side view of a user 700, represented by a stick figure, utilizing the embodiment of the invention illustrated in FIG. 1 to exercise arm muscles. In FIG. 13 significant detail of the embodiment has been omitted for clarity, and FIG. 13 should be viewed with the details shown in FIGS. 1–4 in mind. The total exercise stroke that the user 700 will utilize is a linear path from position I (defined by the solid lines) to position II (defined by the dotted lines) as shown in FIG. 13. This stroke is made up of a resist segment followed by an assist segment. The user starts the exercise stroke by holding the grips 54 with his hands 704 and his arms 702 extended as shown in position I. The user then exerts an upward force on the grips 54 with the arm muscles. This exertion is resisted by the inertia of the directly coupled flywheels 94. In overcoming this inertia and moving the carriage assembly 28 along the guide rods 40 the user will exert an amount of work. This exertion of work occurs during the resist segment of the exercise stroke. An amount of energy substantially equal to the amount of work exerted by the user 700 in displacing the grips 54 is now stored in the moving flywheels. This energy is available to the user 700 during the subsequent assist segment of the exercise stroke. The user 700, during the assist segment of the exercise stroke, may use the stored energy to move muscles through ranges of user's minimal mobility. Alternatively, the user 700 may exercise against the stored energy by exerting a force in the opposite direction of the movement of the grips in order to bring the grips to a stop at position II. In this manner the user's arms 702 are in the bent position shown at position II. The user 700 will have exerted approximately the same amount of work stopping the travel of the grips 54, during the assist segment, as was exerted in displacing the grips 54 during the resist segment. The total movement of the user's arms 702 is similar to a "curl" using free weights. But with this embodiment of the invention, the user has not only exercised the arm muscles that would have been exercised doing a "curl" but has also exercised the opposing set of muscles. The user 700 may now reverse the stroke to move the handgrips from position II back to position I with an exercise stroke that also has resist and assist segments. These motions can be repetitively performed.

Figure 14:
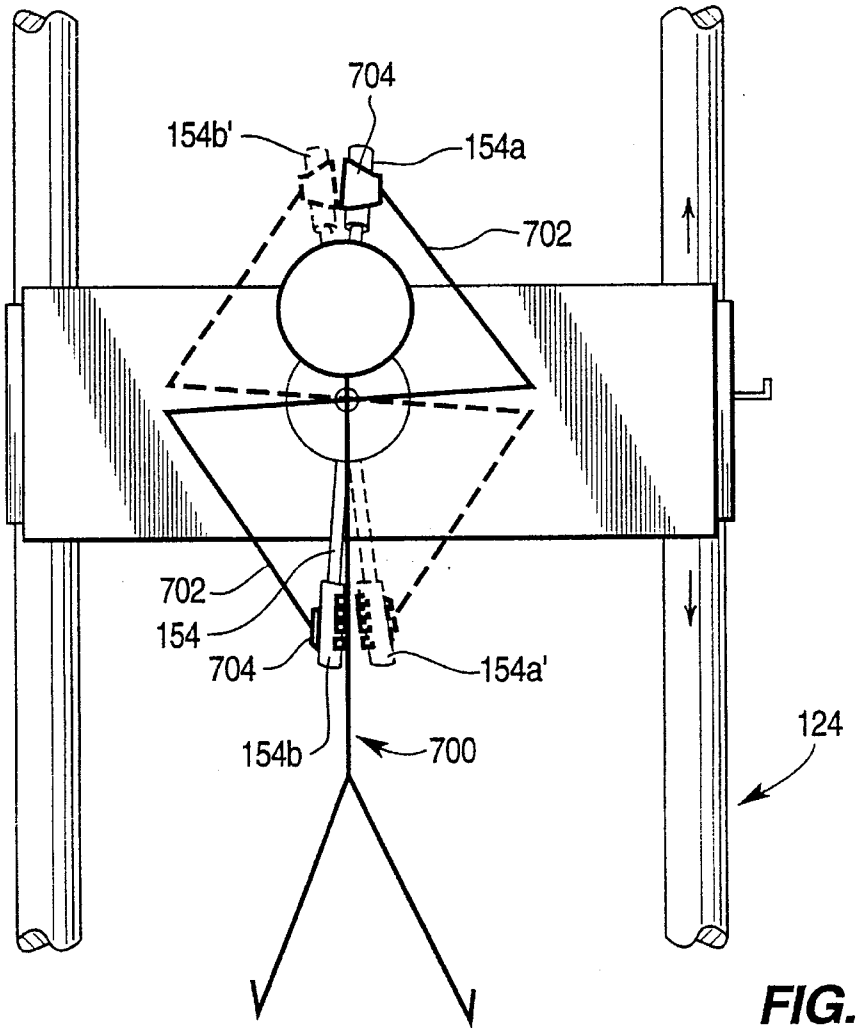
FIG. 14 is a partial front view of the embodiment of the invention shown in FIG. 4, with a user, represented by a stick figure, utilizing the apparatus.

FIG. 14 shows a user 700 standing in front of a partially illustrated embodiment of the invention, which is fully illustrated in FIG. 4. The user 700 is utilizing the embodiment to exercise arm and torso muscles by moving the grips 154 from position I (defined by the solid lines) to position II (defined by the dotted lines). In FIG. 14 significant detail of the embodiment has been omitted for clarity and the figure should be viewed with the details shown in FIG. 5 in mind. This embodiment utilizes handgrips 154 that are gripped by the user's hands 704 which are moved, in this exercise stroke, in a clockwise direction approximately 180 degrees from position I to position II. Other exercise strokes are also available and are obvious to a user of the embodiment. The handgrips 154 are further labelled for clarity where the higher of the two, in position I, is 154*a* while the lower is 154*b*. When these are rotated through the exercise stroke they are labelled 154*a'* and 154*b'* respectively. The user initiates an exercise stroke by starting movement of the grips in the clockwise direction which is resisted by the inertia of the flywheel 194 (shown in FIG. 4). This is the resist segment of an exercise stroke. In moving the handgrips 154*a* and 154*b* through an initial displacement the user will exert an amount of work. An amount of energy capable of performing work substantially equal to that exerted by the user 700 in achieving the displacement of the grips is stored in the rotating flywheel 194. The user 700 may now utilize this energy, during the assist segment of the exercise stroke to move muscles through ranges of minimal mobility. Alternatively, the user 700 may exercise against the energy by exerting work against the handgrips 154 in order to bring the handgrips to a stop at position II (154*a'* and 154*b'*). In this manner, the user 700 has exercised the opposing muscles a substantially equal amount as the muscles exercised during the resist segment of the exercise stroke. The user 700 may now reverse the stroke to move the handgrips from their 154*a'* and 154*b'* positions back to the 154*a* and 154*b* positions through an exercise stroke that also has resist and assist segments. These motions can be repetitively performed.

Figure 15:
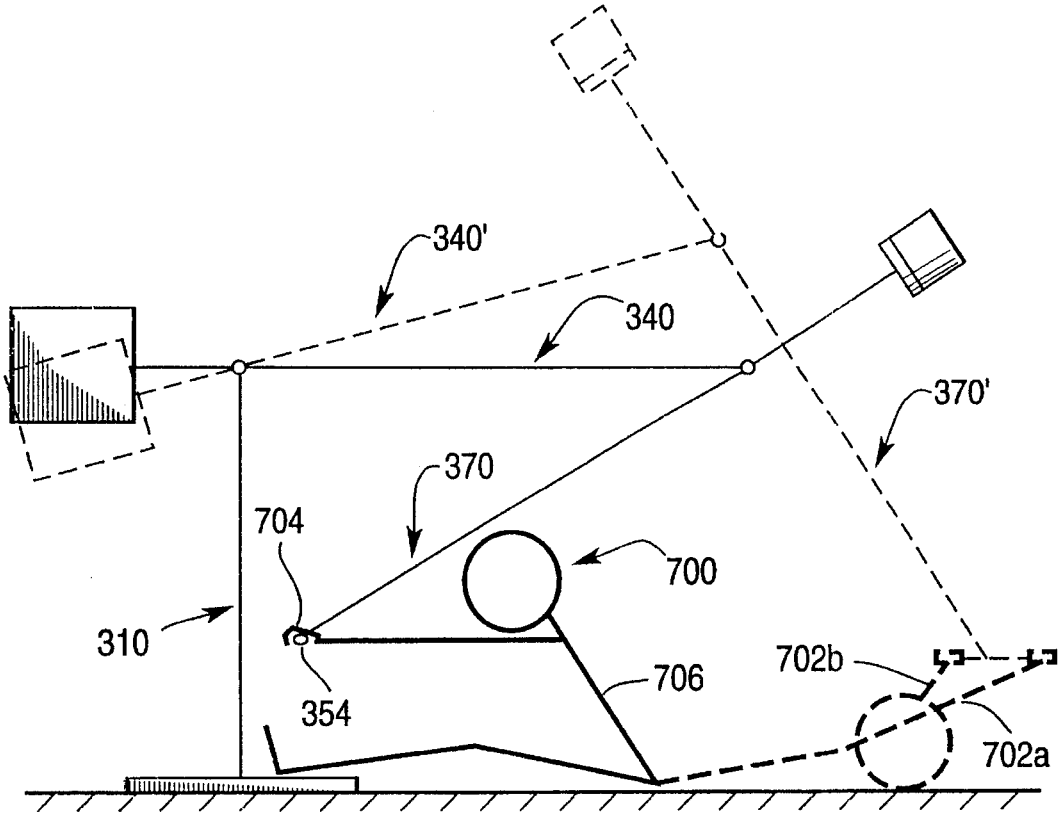
FIG. 15 is a schematic side view of the embodiment of the invention shown in FIGS. 7–10, with a user, represented by a stick figure, utilizing the apparatus.
Figure 16:
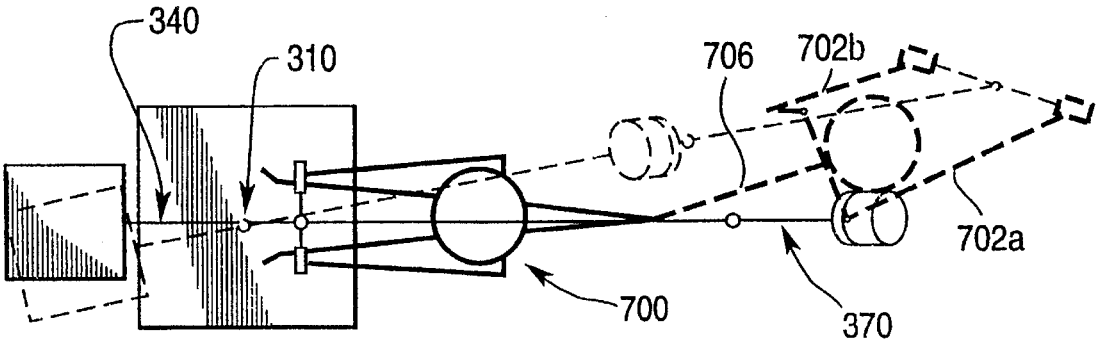
FIG. 16 is a plan view of the apparatus and user shown in FIG. 15.

FIG. 15 shows a side view of a user utilizing the embodiment of the invention fully illustrated in FIGS. 7–10 to perform a three-dimensional exercise stroke with compound linear and circular motion of the grips. The exercise stroke is best understood by also considering the plan view of FIG. 15 that is illustrated in FIG. 16. This embodiment of the invention allows a user 700 to exercise through a generally unconstrained exercise stroke, thereby exercising multiple muscle groups. This feature of the embodiment allows certain muscles to be in a resist segment of the exercise stroke while other muscles are in an assist segment, while also providing for the more conventional muscle actions described in FIGS. 13 and 14. The illustrated exercise stroke has the user 700 moving the grips 354 from position I (defined with the solid lines) to position II(defined in the dotted lines). The user 700 starts from a sitting position (position I) with his hands 704 on the grips 354. The user 700 then, in a fluid motion, moves the grips 354 to position II where the user 700 is in a generally prone position with a slight twist in the torso 706 so that one arm 702*a* is fully extended and the other arm 702*b* is bent. This exercise stroke utilizes the balanced inertia of the primary and secondary arms 370 and 340, along with the inertia of the flywheels 394 to provide the resist/assist function of the invention to the user 700. The component of the exercise stroke that involves rotational motion of the handgrips 354 with respect to the primary arm 370 is effected by the flywheels 394 while the other motion is effected by the inertia of the balanced primary and secondary arms 370 and 340. This embodiment allows a flexible exercise stroke with the embodiment presenting resist and assist segments to the user at various intervals. The embodiment still requires an initial resist segment where the handgrips 354 are set in motion by the user exerting work. An amount of energy substantially equal to the amount of work the user exerted displacing the grips is stored in the moving masses of the embodiment and available to the user for discrete assist segments during the total exercise stroke.

It will be apparent from the foregoing that particular embodiments of the invention have been described and that modifications may be made therein without departing from the spirit of the invention. Accordingly the scope of the invention should be determined not only by the illustrated embodiments but by the appended claims and their legal equivalents.

Having thus described the invention, what it is desired to protect by Letters Patent and hereby claim is:

1. An exercise apparatus for providing a user with a resist segment followed by an assist segment, the apparatus comprising:

(a) a thrust receiver having user interface means capable of displacement along an exercise stroke;

(b) an inertial element for providing a resisting force to displacement of said thrust receiver, said inertial element comprising a hydraulic assembly, said inertial dement further comprising means for storing energy generated during the resist segment of said exercise stroke, and further comprising means for dissipation of the stored energy by the user against said thrust receiver during the assist segment of said exercise stroke, whereby stored energy is totally depleted at the completion of said exercise stroke; and (c) a linkage assembly for linking said thrust receiver in a driving and driven relationship to said inertial element.

2. The exercise apparatus of claim 1 wherein the thrust receiver comprises a pair of handgrips.

3. The exercise apparatus of claim 1, further comprising a framework adapted to constrain the motion of said thrust receiver to linear motion in response to a thrust.

4. The exercise apparatus of claim 1, further comprising a framework adapted to constrain the motion of the thrust receiver to rotary motion in response to a thrust.

5. The exercise apparatus of claim 1 wherein said hydraulic assembly consists of a linear hydraulic assembly comprising:

(a) a tubular cylinder;

(b) an incompressible fluid in said tubular cylinder;

(c) a piston within said tubular cylinder, the piston being in a driving and driven relationship with said incompressible fluid;

(d) a rod driven by said thrust receiver attached to said piston, whereby said thrust receiver is in a driving and driven relationship to said piston;

(e) a means for providing movement inertia;

(f) a transmission unit in a driving and driven relationship with said incompressible fluid, said transmission unit also being in a driving and driven relationship with said means for providing movement inertia.

6. The exercise apparatus of claim 5 wherein said means for providing movement inertia comprises a flywheel.

7. The exercise apparatus of claim 5, further comprising a framework adapted to constrain the motion of the thrust receiver to linear motion in response to a thrust.

8. The exercise apparatus of claim 1 wherein said hydraulic assembly consists of a toroidal hydraulic assembly comprising:

(a) a toroidal tube;

(b) an incompressible fluid in said tube;

(c) a magnetic piston within said toroidal tube, said piston being in a driving and driven relationship with said incompressible fluid;

(d) a yoke having a magnetic field therein around said toroidal tube whereby the attraction between said yoke and said piston maintains them in a generally fixed relationship and a force on said yoke is transmitted to said piston, and a force on said piston is transmitted to said yoke; and (c) a rod driven by said thrust receiver attached to said yoke, whereby a force on said thrust receiver is transmitted to said yoke and a force on said yoke is transmitted to said thrust receiver.

9. The exercise apparatus of claim 8, further comprising a framework adapted to constrain the motion of the thrust receiver to rotary motion in response to a thrust.

10. An exercise apparatus comprising:

(a) a base;

(b) a support structure mounted on said base;

(c) a extension rotatably mounted on said support structure;

(d) an arm with a first and a second end pivotally mounted on said extension (e) a thrust receiver capable of linear and rotational displacement pivotally mounted on the first end of said arm;

(f) a counterweight sufficient to balance said arm and said thrust receiver mounted on the second end of said arm;

(g) a linear hydraulic assembly comprising;

(i) a tubular cylinder;

(ii) an incompressible fluid in said tubular cylinder;

(iii) a piston within said tubular cylinder, the piston being in a driving and driven relationship with said incompressible fluid;

(iv) a rod with a first end and a second end;

(v) said rod being universally mounted by its first end to the first end of said arm and being attached by its second end to said piston, whereby said rod is in a driving and driven relationship to said piston;

(vi) a means for providing movement inertia;

(vii) a transmission unit in a driving and driven relationship with said incompressible fluid, said transmission unit also being in a driving and driven relationship with said means for providing movement inertia;

(h) a fixture for mounting said linear hydraulic assembly to said base wherein the fixture permits movement of said linear hydraulic assembly to any radial position about the point of fixation of said fixture to said base;

(j) a toroidal hydraulic assembly wherein said toroidal hydraulic assembly comprises;

(i) a toroidal tube;

(ii) an incompressible fluid in said tube;

(iii) a magnetic piston within said toroidal tube said piston being in a driving and driven relationship with said incompressible fluid;

(iv) a yoke having a magnetic field therein around said toroidal tube whereby the attraction between said yoke and said piston maintains them in a generally fixed relationship and a force on said yoke is transmitted to said piston, and a force on said piston is transmitted to said yoke; and (k) a fixture for mounting said toroidal hydraulic assembly around said support structure;

(l) a fixture for mounting said yoke to said rotatably mounted extension.

11. The exercise apparatus of claim 10 further having means adapted to provide handgrips for grasping by the hands of the user.

12. The exercise apparatus of claim 10 further having means adapted to provide shoes, toe-clips or straps for the feet of the user.

* * * * *